US006568571B2

(12) United States Patent
Ando et al.

(10) Patent No.: US 6,568,571 B2
(45) Date of Patent: May 27, 2003

XCHANGEABLE CONTINUOUS CASTING NOZZLE

(75) Inventors: Mitsuru Ando, Gifu (JP); Shigeaki Takahashi, Gifu (JP); Yasushi Sasajima, Gifu (JP)

(73) Assignee: Tokyo Yogyo Kabushiki Kaisha & Akechi Ceramics Kabushiki Kaisha (JP)

( * ) Notice: Subject to any disclaimer, the term of this patent is extended or adjusted under 35 U.S.C. 154(b) by 0 days.

(21) Appl. No.: 09/732,825

(22) Filed: Dec. 8, 2000

(65) Prior Publication Data

US 2001/0035438 A1 Nov. 1, 2001

(30) Foreign Application Priority Data

Apr. 28, 2000 (JP) ..... 2000-130547

(51) Int. Cl.[7] ..... B22D 41/08
(52) U.S. Cl. ..... 222/606; 164/437
(58) Field of Search ..... 222/600, 606, 222/607, 591; 164/437

(56) References Cited

U.S. PATENT DOCUMENTS 5,198,126 A * 3/1993 Lee ..... 222/606
5,467,904 A * 11/1995 Shaw ..... 222/606
5,954,989 A * 9/1999 Brook et al. ..... 222/606

* cited by examiner

*Primary Examiner*—Scott Kastler
(74) *Attorney, Agent, or Firm*—Cohen & Grigsby, P.C.

(57) ABSTRACT

An exchangeable continuous casting nozzle used for a slide nozzle device connected to an upper nozzle disposed on a bottom portion of a container for molten metal, comprises a nozzle including a flange portion made of a refractory material having a through hole for receiving molten metal flowing out of the upper nozzle, and a tube body of a refractory material having another through hole following the through hole, and a metal protecting body including a metal casing portion surrounding the flange portion, a metal skirt portion surrounding an upper portion of the tube body following the flange portion, and metal reinforcing portions disposed on the slide nozzle device in parallel with a direction to detach/attach the nozzle, for reinforcing junction between the metal casing portion and the metal skirt.

9 Claims, 5 Drawing Sheets

EXCHANGEABLE CONTINUOUS CASTING NOZZLE

BACKGROUND OF THE INVENTION

1. Field of the Invention

The present invention relates to an exchangeable continuous casting nozzle used for a slide nozzle device which pours molten metal such as molten steel into a casting mold, while controllably feeding the molten metal from a container such as a ladle and a tundish in a metal casting field.

2. Description of the Related Art

The slide nozzle device pours molten metal into a casting mold from a container for molten metal, e.g. a tundish. A conventional slide nozzle device is generally shown in FIG. 4. A conventional slide nozzle device attached to a bottom wall of the tundish comprises an upper nozzle 1 disposed on a bottom wall of the tundish, an upper fixed plate 2 supporting the upper nozzle 1 from below, a lower fixed plate 3, and a sliding plate 4 disposed between the upper fixed plate 2 and the lower fixed plate 3 and operated by a sliding means 5 to turn on/turn off the molten metal.

The slide nozzle device further comprises a collector nozzle 6 connected to the lower fixed plate 3 and an immersion nozzle 10 extending into a casting mold, and surrounded by a metal mantle 12, and a frame 18 uniting the above plates and nozzles in a body. These nozzles are made of various refractory materials. Further, a fixing flange 14 is fastened, through a metal supporting bar 13, to a metal casing 15 that surrounds the lower fixed plate 3. Fixing flange 14 unites the lower fixed plate 3, the collector nozzle 6, and the immersion nozzle 10 in a body. Arms 16 disposed beneath the frame 18 mounting the sliding means 5 fix the lower fixed plate 3, the collector nozzle 6, and the immersion nozzle 10, all of which are united in the frame 18.

The molten metal in the container passes through a through hole 1A of the upper nozzle 1, a through hole 2A of the upper fixed plate 2, a through hole 4A of the sliding plate 4, a through hole 3A of the lower fixed plate 3, a through hole 6A of the collector nozzle 6, and a through hole 10A of the immersion nozzle 10, and then it is poured into the casting mold (not shown).

The conventional slide nozzle device has a problem that the air is entrapped into the through holes through seams between the lower fixed plate 3 and the collector nozzle 6, and between the collector nozzle 6 and the immersion nozzle 10, thereby causing the molten metal to be oxidized, which deteriorates the quality of the molten metal.

The reasons for the above problem are given in details as follows:

(1) Mortar disposed in the seam between the collector nozzle 6 and the immersion nozzle 10 deteriorates in plasticity due to heat of the molten metal passing through the through holes inside the nozzles.

(2) The metal supporting bar 13 fastening the fixing flange 14 is subjected to thermal expansion, thereby decreasing the fastening force of fastening the lower fixed plate 3, the collector nozzle 6, and the immersion nozzle 10.

(3) The fastening force due to the metal supporting bar 13 and the bending moment caused at replacing the nozzle, etc., causes the mating faces of the collector nozzle 6 and the immersion nozzle 10 to be broken. Furthermore, the slide nozzle device has other problems related to the time required to unite the collector nozzle 6 and the immersion nozzle 10, and to the economical efficiency such as the manufacturing cost.

Therefore, in order to solve the above-mentioned problems, a Japanese Provisional Patent Publication (Kokai) No. 6-13457 has disclosed, as shown in FIG. 5, an integral nozzle 30 in which the lower fixed plate, the collector nozzle and the immersion nozzle are integrated with one another in a body. The integral nozzle 30 comprises a tube body 32 made of a refractory material and a flange portion 33 contacting to the sliding plate. An upper part of an inner circumferential portion of the tube body 32 and an upper face of the flange portion 33 are formed with an insert portion 34 made of a wear-resistant and greater hardness refractory material, and then the flange portion 33 is surrounded by a metal casing 35.

This integral nozzle eliminates the need for using mortar in the seam between the collector nozzle and the immersed nozzle, etc., which solves the problem of oxidizing the molten metal due to lowering of the sealing property. Further, a metal mantle, bolts and nuts required to unite the collector nozzle and the immersion nozzle can be eliminated, which brings about the resolution of the problems related to the manufacturing cost and time.

However, the existent continuous casting nozzles are clogged during long time use, which requires a frequent replacement of the nozzle. Further, the replacement must be carried out quickly in order to increase the efficiency, which causes the bending stress to be applied in a direction to replace the nozzle.

In the integral nozzle 30 disclosed in Japanese Provisional Patent Publication (Kokai) No. 6-13457, since the whole integral nozzle 30 is made of a refractory material, the performance of the sealing property is improved and further the total length of the nozzle is increased. However, it has other problems related to not only the transportation and the handling, but also occurrence of the breakage due to the weak strength against the bending stress in a direction to replace the nozzle. Moreover, the above-mentioned nozzle should be replaced more frequently, which requires quickness of the replacing work, improvement of the safety, and easiness of replacing the nozzle.

It is therefore an object of the invention to provide a continuous casting nozzle used for a slide nozzle device, which is capable of being easily transported and being quickly and safely replaced, and further is not easily damaged on handling, particularly, on replacing.

SUMMARY OF THE INVENTION

To attain the above object, the inventor has paid a keen attention to reinforcing of a continuous casting nozzle, conjunction between a metal casing portion surrounding a flange portion and a metal skirt portion surrounding a tube body, and thereby have invented the following:

The present invention provides an exchangeable continuous casting nozzle to be used in a slide nozzle device, comprising:

(a) a nozzle including a flange portion made of a refractory material having a through hole for receiving molten metal flowing out of the upper nozzle, and a tube body of a refractory material, continuing from the flange portion and having another through hole continuing from the through hole, and (b) a metal protecting body including a metal casing portion surrounding the flange portion, a metal skirt portion surrounding an upper portion of the tube body, and metal reinforcing portions disposed around a junction between the metal casing portion and the metal skirt portion in parallel with a direction to detach/attach the nozzle for reinforcing.

The exchangeable continuous casting nozzle has the metal reinforcing portions on the connecting portion of the metal casing portion and the metal skirt portion in parallel with the nozzle attaching/detaching direction; therefore, quick replacement of the integral nozzle prevents the nozzle from being broken at a connecting at portion between the flange portion and the tube body.

Preferably, the metal reinforcing portion comprises a reinforcing portion shaped like a half rectangular in horizontal section, fixed to the metal casing portion and the metal skirt portion from the outside.

This metal reinforcing portion is simple in contour, which ensures easy working and a sufficient strength of the metal reinforcing portion.

Preferably, the metal reinforcing portion comprises a reinforcing portion having a curved portion which is identical in curvature with the metal skirt portion, and a plate-like portion connected to the curved portion, the reinforcing portion being fixed to the metal casing portion and the metal skirt portion from the outside.

This metal reinforcing portion is complicated in contour; however, preliminarily preparing parts enables the parts to be easily welded, and so on.

Preferably, the metal reinforcing portion comprises a reinforcing portion having a curved portion which is shaped like a circle or polygon in horizontal section, and a bar-like member, the reinforcing portion being fixed to the metal casing portion and the metal skirt portion from the outside.

This metal reinforcing portion is simple in contour, which ensures easy working and a sufficient strength of the metal reinforcing portion.

Preferably, the metal reinforcing portion comprises a reinforcing portion shaped like a crescent in horizontal section, fixed to the metal casing portion and the metal skirt portion from the outside.

This metal reinforcing portion is complicated in contour; however, preliminarily preparing parts enables the parts to be easily welded, and so on.

Preferably, the metal reinforcing portion comprises a reinforcing portion shaped like a triangle in vertical section, fixed to the metal casing portion and the metal skirt portion from the outside.

This metal reinforcing portion is simple in contour, which ensures easy working and a sufficient strength of the metal reinforcing portion.

Preferably, the metal reinforcing portion comprises a reinforcing portion shaped like a deformed pentagon in vertical section, fixed to the metal casing portion and the metal skirt portion from the outside.

This metal reinforcing portion is simple in contour, which also ensures easy working and a sufficient strength of the metal reinforcing portion.

More preferably, the flange portion comprises at least two refractory material layers of a lower layer and an upper layer, the lower layer being made of the same refractory material as the tube body, and the upper layer being made of a refractory material which is greater in hardness than the tube body.

It is preferable that an upper face of the flange portion contacts to the lower fixed plate or the sliding plate which is greater in hardness, and that it is greater in hardness than the tube body so as not to be eroded by the flowing molten metal.

Further preferably, the flange portion is preferably made of three refractory layers of a lower layer, an intermediate layer, and an upper layer, the lower layer being made of the same material as the tube body which is less in hardness, and then the intermediate layer and the upper layer are made of materials which become greater in hardness in order than the tube body.

The intermediate layer has an intermediate hardness between those of the tube body and the upper layer, which prevents the lower layer and the upper layer from being separated due to the difference between the thermal expansion thereof.

Further advantages of the invention will be apparent from the following description of the preferred embodiments of the invention as illustrated in the accompanying drawings.

DETAILED DESCRIPTION OF THE PREFERRED EMBODIMENTS

The invention will now be described in detail with reference to the drawings showing respective embodiments.

Figure 1:
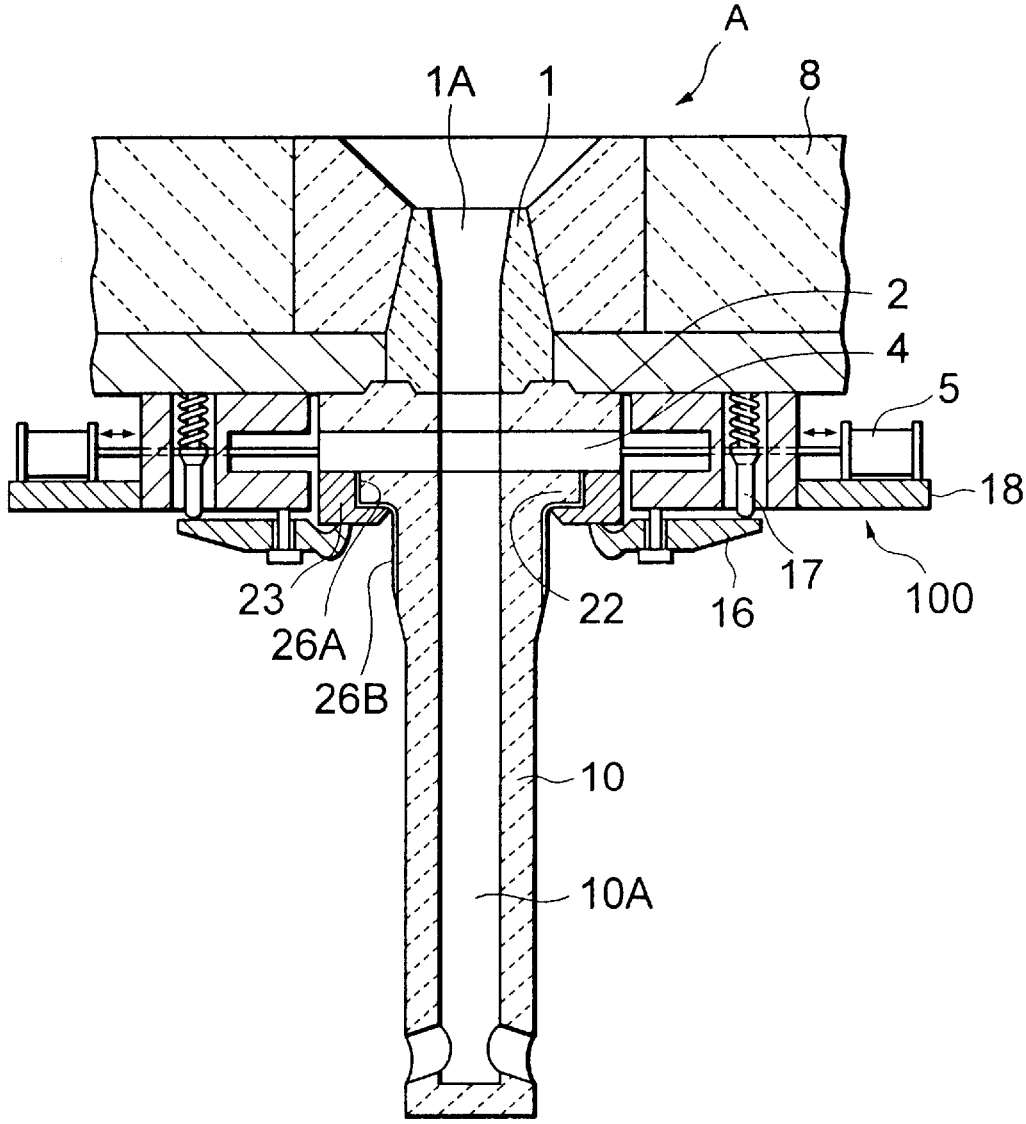
FIG. 1 is a sectional drawing of a slide nozzle device using an exchangeable continuous casting nozzle according to the present invention.

An embodiment of the invention will now be described with reference to FIG. 1. There is shown in FIG. 1 an example of a tundish as a container for molten metal and also a slide nozzle device 100 connected to an upper nozzle 1 which is embedded in a bottom brick of the tundish. The slide nozzle device 100 comprises an upper fixed plate 2, a sliding plate 4, and a frame 18 accommodating the upper fixed plate 2 and the sliding plate 4. The frame 18 is provided with a sliding means 5 for sliding the sliding plate 4, and an arm 16 for pressing the upper fixed plate 2 and the sliding plate 4 accommodated in the frame 18, and a flange portion 22 of an exchangeable integral nozzle 10 from below.

The arm 16 receives a reactive force of a spring fixed to the frame 18, and presses a supporting member 23 for supporting the flange portion 22 of the exchangeable integral nozzle 10, and the like. The flange portion 22 of the integral nozzle 10 and an upper part of the tube body continuing from the flange portion 22 are surrounded by a metal casing portion 26A and a metal skirt portion 26B. The metal casing portion 26A and the metal skirt portion 26B protect the integral nozzle 10, thereby enables the integral nozzle 10 to be protected from damage when attached to or detached from the supporting member 23 of the slide nozzle device 100. As the supporting member 23 comprises two rails disposed parallel to each other and the nozzle 10 can be inserted into the slide nozzle device 100 in the direction perpendicular of this drawing, the metal casing portion 26A and the metal skirt portion 26B are reinforced by metal reinforcing portions 20 not shown in this figure. However, it is described in FIG. 2*a* and FIG. 2*b*.

Figure 2A:
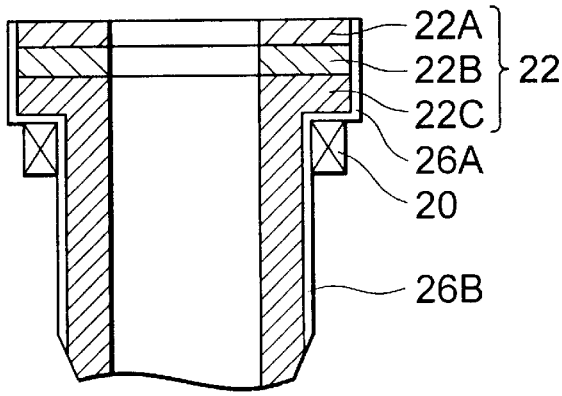
FIG. 2*a* is a sectional drawing of a head portion of an exchangeable continuous casting nozzle according to the present invention.
Figure 2B:
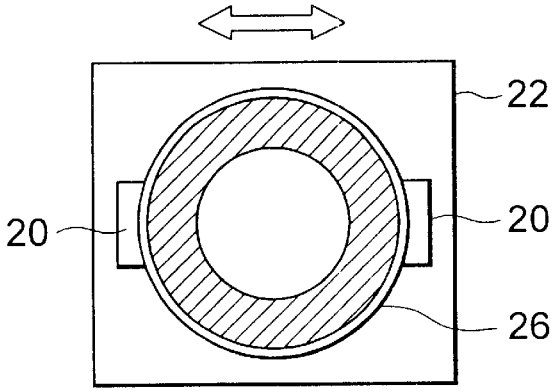
FIG. 2*b* is a drawing of the nozzle of FIG. 2*a* as viewed from below.

FIG. 2*a* is a sectional drawing of a head portion of a continuous casting nozzle according to the invention, and FIG. 2*b* is a view of the nozzle of FIG. 2*a* as viewed from below. FIGS. 2*c* to 2*g* are perspective views showing various embodiments of a metal reinforcing portion.

In FIG. 2*a* and FIG. 2*b*, the flange portion 22 is surrounded by the metal casing portion 26A, and an upper part of the tube body continuing from the flange portion 22 is protected by the metal skirt portion 26B. The metal casing portion 26A and the metal skirt portion 26B are integrally made of an iron plate of 1 to 3 mm thickness. Therefore, moving the integral nozzle 10 in an attaching/detaching direction to attach to or detach from the integral nozzle 10 causes a connecting portion of the flange portion 22 and the tube portion to be damaged due to a large bending moment caused by the exchange of the integral nozzle 10.

Figure 2C:
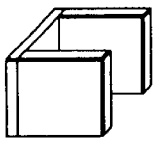
FIGS. 2*c*, 2*d*, 2*e*, 2*f*, 2*g*, and 2*h* are perspective views showing various embodiments of a metal reinforcing portion.

Therefore, a pair of the metal reinforcing portions 20 are, as shown in FIG. 2*b*, disposed on both sides of the connecting portion of the metal casing portion 26A and the metal skirt portion 26B with respect to the nozzle attaching/detaching direction. FIG. 2*c* shows a reinforcing portion 20 shaped like a half rectangular in horizontal section, fixed to the metal casing portion 26A and the metal skirt portion 26B from the outside. This half rectangular-shaped reinforcing portion 20 is simple in contour, which ensures easy working and a sufficient strength of the metal reinforcing portion. In this embodiment, the metal casing portion 26A, the metal skirt portion 26B and the metal reinforcing portion 20 constitute a metal protection body 26.

Figure 2D:
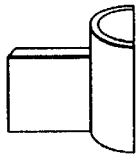

A metal reinforcing portion 20 shown in FIG. 2*d* comprises a reinforcing portion having a curved portion which is identical in curvature with the metal skirt portion 26B, and a plate-like portion fixed to the curved portion, the reinforcing portion being fixed to the metal casing portion 26A and the metal skirt portion 26B from the outside.

This metal reinforcing portion 20 is complicated in contour; however, preliminarily preparing parts enables the parts to be easily welded, and so on.

Figure 2E:
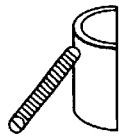

A metal reinforcing portion shown in FIG. 2*e* comprises a reinforcing portion 20 having a curved portion which is shaped like a circle or polygon in horizontal section, and a bar-like member, the reinforcing portion being fixed to the metal casing portion 26A and the metal skirt portion 26B from the outside.

This metal reinforcing portion 20 is simple in contour; however, it can be easily made by welding, and so on.

Figure 2F:
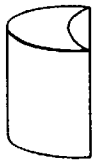

A metal reinforcing portion 20 shown in FIG. 2*f* comprises a reinforcing portion shaped like a crescent in horizontal section, fixed to the metal casing portion 26A and the metal skirt portion 26B from the outside.

This metal reinforcing portion 20 is complicated in contour; however, preliminarily preparing parts enables the parts to be easily welded, and so on.

Figure 2G:
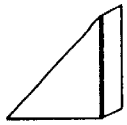

An metal reinforcing portion 20 shown in FIG. 2*g* comprises a reinforcing portion shaped like a triangle in vertical section, fixed to the metal casing portion 26A and the metal skirt portion 26B from the outside. This metal reinforcing portion 20 is simple in contour; however, it can be easily made by welding, and so on.

Figure 2H:
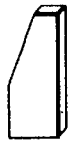

A metal reinforcing portion 20 shown in FIG. 2*h* comprises a deformed pentagon in vertical section, fixed to the metal casing portion 26A and the metal skirt portion 26B from the outside. This metal reinforcing portion 20 is simple in contour; however, it can be easily made by welding, and so on.

The reinforcing portion can be constructed by selecting not only one type but also two or more types as illustrated from FIGS. 2*c* to 2*h* so long as the portion can be inserted into the supporting member 23. For example the half rectangular member (FIG. 2*c*) can be more reinforced by combination of the triangle (FIG. 2*g*) or the deformed pentagon (FIG. 2*h*). The material of the metal protecting body 26, which should not be particularly limited by this specific description, is preferably made of usual steel plate which is inexpensive, and capable of being easily welded. The exchangeable integral casting nozzle 10 should be provided with at least a pair of the metal reinforcing portions 20 on the connecting portion of the metal casing portion 26A and the metal skirt portion 26B in parallel with the nozzle attaching/detaching direction; therefore, quick replacement of the nozzle 10 prevents the nozzle from being broken at an intermediate portion between the flange portion 22 and the tube body.

Then, a pair of the metal reinforcing portions 20 are arranged in parallel with the nozzle attaching/detaching direction, which effectively reduces the bending stress applied to the metal skirt portion 26B, and enables the nozzle 10 to be replaced quickly and smoothly according to the shape of the casting mold. The above-mentioned metal reinforcing portions 20 basically reinforces the resistance against the bending stress of the nozzle 10 with respect to the nozzle attaching/detaching direction of the nozzle 10, and also prevents the exchangeable nozzle 10 to be wrongly inserted into the slide nozzle device 100. As the exchangeable nozzle 10 is inserted perpendicularly to the sheet of FIG. 1 for exchange, it is interfered with the supporting members 23 made of two rails arranged parallel with each other, which prevents the nozzle 10 to be inserted into the slide nozzle device 100 in the wrong direction.

Figure 3A:
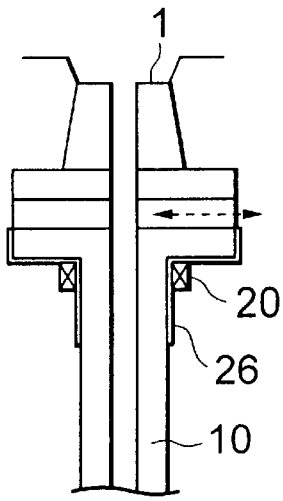
FIGS. 3*a*, 3*b*, 3*c*, 3*d*, 3*e*, and 3*f* are sectional drawings showing various embodiments of a slide nozzle device using an exchangeable continuous casting nozzle according to the present invention.
Figure 3B:
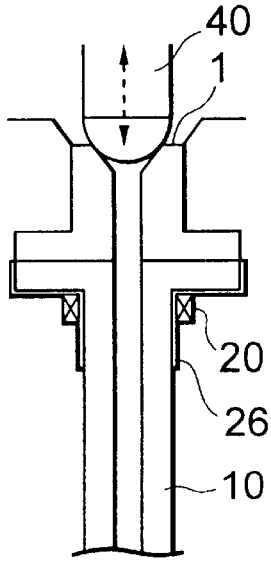
Figure 3C:
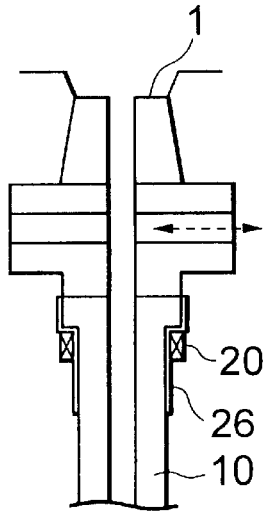
Figure 3D:
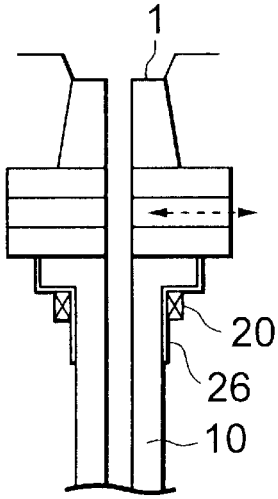
Figure 3E:
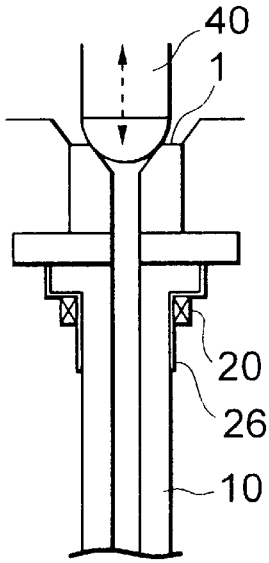
Figure 3F:
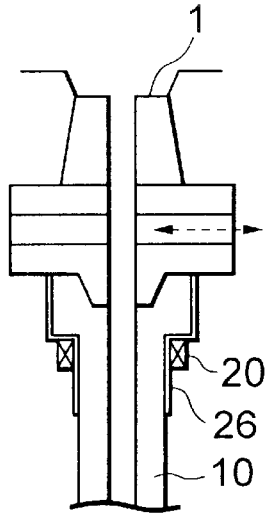
Figure 4:
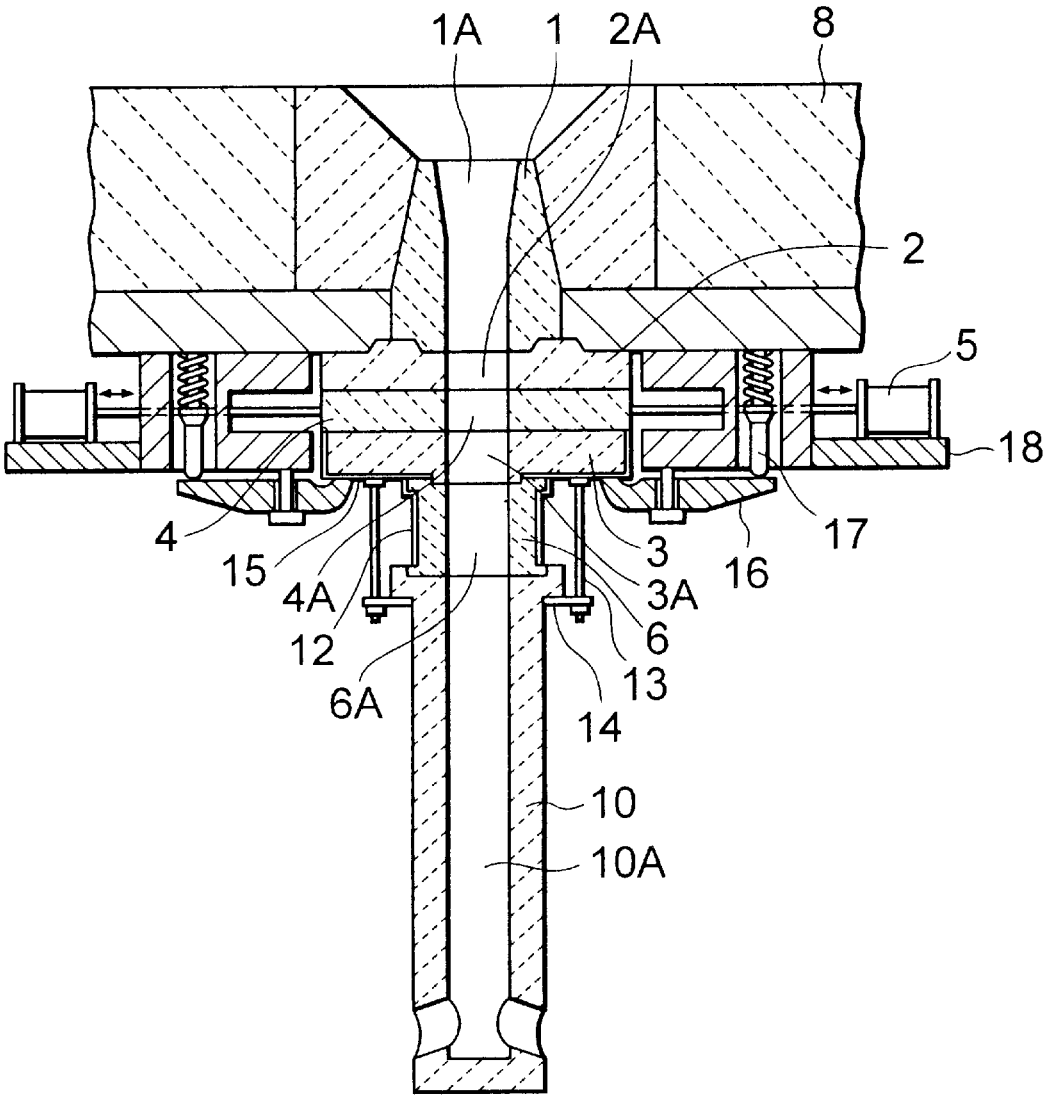
FIG. 4 PRIOR ART
FIG. 4 is a sectional drawing of a slide nozzle device.
Figure 5:
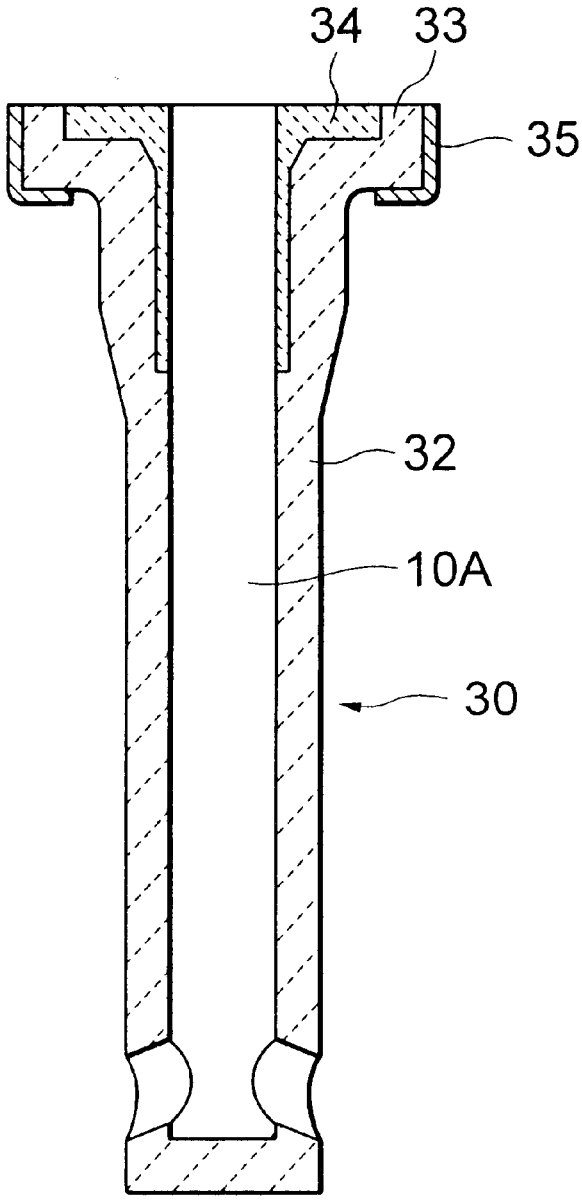
FIG. 5 PRIOR ART
FIG. 5 is a sectional drawing of a conventional casting nozzle.

FIGS. 3*a* to 3*f* are sectional views showing various combination of parts of the slide nozzle device 100 using the exchangeable nozzle 10 according to the invention. FIG. 3*a* shows an embodiment of the slide nozzle device 100 corresponding to that of FIG. 1, in which the flange portion 22 of the nozzle 10 directly contacts to the sliding plate 4. FIG. 3*b* shows an embodiment the slide nozzle device 100 in which the nozzle 10 directly contacts to the upper fixed plate 2 because the molten metal pouring is controlled by the tundish stopper 40. FIG. 3*c* shows an embodiment of the slide nozzle device 100 in which the flange portion 22 contacts to a protrusion of the lower fixed plate 3. FIG. 3*d* shows an embodiment of the slide nozzle device 100 in which the nozzle 10 contacts to the lower fixed plate 3 from below. FIG. 3*e* shows an embodiment of the side nozzle device 100 which is substantially identical with that of FIG. 3*b*. FIG. 3*f* shows an embodiment of the side nozzle device 100 in which the flange portion 22 has a recess portion fitted to a protrusion of the lower fixed plate 4.

Particularly in the embodiment of FIG. 1, i.e. FIG. 3*a* among the above-mentioned embodiments, the flange portion 22 is made of preferably at least two layers comprising an upper layer (22A) and a lower layer 22C as suggested in FIG. 2*a* (the intermediate layer 22B should be ignored). The lower layer 22C is made of a refractory material which is substantially identical with that of the tube body, and the upper layer (22A) is made of material which are greater in hardness and in anti-wearing property than the refractory material of the tube body. This prevents the upper face of the flange body 22 from being eroded by the molten metal flowing down, although the upper face of the flange body 22 contacts to the lower fixed plate 3 or the sliding plate 4 which is greater in hardness.

The flange portion 22 can be made of three refractory layers of an upper layer 22A, an intermediate layer and a lower layer 22C as shown in FIG. 2*a*. The lower layer 22C is made of the same material as that of the tube body which is less in hardness, and then the intermediate layer 22B and the upper layer 22A are made of materials which becomes greater in hardness in order than the tube body. This prevents the tube body of a less hardness and the upper layer of a greater hardness from being separated due to the difference of the heat expansion therebetween.

The tube body is preferably made of a refractory material having erosion resistance, i.e. aluminum-graphite brick mainly made of alumina of about 45 wt %, graphite, and silica, e.g. aluminum-graphite material mainly made of alumina of about 45 wt %, silica of about 25 wt %, and graphite of about 30 wt %. The same is true for the material of the lower layer 22C of the flange portion 22.

The intermediate layer 22B is preferably made of refractory material having alumina of over about 50 wt %, e.g. aluminum-graphite material mainly made of alumina of about 63 wt %, silicon carbide (SiC) of about 5 wt %, and graphite of about 32 wt %. The upper layer 22A is preferably made of refractory material of a greater hardness, e.g. alumina of about 60 wt %, silicon carbide of about 10 wt %, and graphite of about 20 wt %.

In addition, preferably, the inner wall of the nozzle on which the molten metal, particularly the molten steel, flows is preferably made of a material having a high erosion resistance. Further, a part and the vicinity of the outer face of the nozzle contacting to casting mold powder is preferably coated by a material having a high erosion resistance to the casting mold powder, e.g. zirconia refractory material including zirconia of about 75 wt %, and graphite of 20 wt %.

The above-mentioned nozzle is manufactured by a conventional method of forming the nozzle as one body preferably by cold hydrostatic pressure forming method, and then sintering it.

While the above is a description of various embodiments of the present invention, the scope of the present invention should not be limited by the specific structures disclosed, and should include any other embodiments and equivalent which those skilled in the art can easily employ.

The exchangeable continuous casting nozzle according to the invention is reinforced by metal protecting bodies each comprising a metal reinforcing portion for a metal casing portion and a metal skirt portion. Therefore, it is possible to prevents the nozzle from being broken, and to quickly and safely move and replace the nozzle.

Further, disposing the metal protecting portions in parallel with a nozzle attaching/detaching direction, thereby making the direction of the bending stress applied to the nozzle parallel to the nozzle moving direction, which effectively decreases the bending stress, and further enables the nozzle to be attached to or detached from a container, or the like. This enables the nozzle to be quickly replaced in various casting work.

Moreover, the metal reinforcing portion has also an effect to prevent the nozzle from being wrongly inserted into a slide nozzle device. The metal reinforcing portion is shaped into a contour of the metal casing portion and the metal skirt portion, or such a contour as to be suited to the frequencies of the nozzle replacement, which results in reinforcement of conjunction between the metal casing portion and the metal skirt portion.

What is claimed is:

1. A slide nozzle device comprising:

(a) an exchangeable continuous casting nozzle that includes:

(i) a nozzle including a flange portion that is made of a refractory material, said nozzle having a first through hole for receiving molten metal, said nozzle also having a tube body of a refractory material that continues from said flange portion and that has a second through hole that continues from said first through hole; and (ii) a metal protecting body that includes a metal casing portion that surrounds the flange portion of said nozzle, a metal skirt portion that surrounds an upper portion of said tube body of said nozzle, and metal reinforcing portions that are disposed around a junction between said metal casing portion and said metal skirt portion to reduce the breakage of the tube body connected with the flange portion;

(b) a first supporting member for securing said exchangeable continuous casting nozzle in said slide nozzle device; and (c) a second supporting member for securing said exchangeable continuous casting nozzle in said slide nozzle device, said second supporting member being substantially parallel to said first supporting member and also being spaced apart from said first supporting member such that said exchangeable continuous casting nozzle can be inserted into said slide nozzle device between said first and second supporting members with said metal reinforcing portions of the metal protecting body of the exchangeable continuous casting nozzle being in parallel with the direction for inserting the exchangeable continuous casting nozzle.

2. A nozzle device as claimed in claim 1, wherein said metal reinforcing portion comprises a portion shaped like a half rectangular shape in horizontal section, said metal reinforcing portion being fixed to the outside of said metal casing portion and to the outside of said metal skirt portion.

3. A nozzle device as claimed in claim 1, wherein said metal reinforcing portion comprises a curved portion which is identical in curvature with said metal skirt portion, and a plate portion that is fixed to said curved portion, said reinforcing portion being fixed to the outside of said metal casing portion and to the outside of said metal skirt portion.

4. A nozzle device as claimed in claim 1, wherein said metal reinforcing portion comprises a reinforcing portion having a curved portion which is shaped like a circle or polygon in horizontal section, and a bar member, said reinforcing portion being fixed to the outside of said metal casing portion and to the outside of said metal skirt portion.

5. A nozzle device as claimed in claim 1, wherein said metal reinforcing portion comprises a portion shaped like a crescent in horizontal section, fixed to the outside of said metal casing portion and to the outside of said metal skirt portion.

6. A nozzle device as claimed in claim 1, wherein said metal reinforcing portion comprises a portion shaped like a triangle in vertical section, fixed to the outside of said metal casing portion and to the outside of said metal skirt portion.

7. A nozzle device as claimed in claim 1, wherein said metal reinforcing portion comprises a portion shaped like a deformed pentagon shape in vertical section, fixed to the outside of said metal casing portion and to the outside of said metal skirt portion.

8. A nozzle device as claimed in claim 1, wherein said flange portion comprises at least two refractory material layers of a lower layer and an upper layer, said lower layer being made of the same refractory material as said tube body, and said upper layer being made of a refractory material greater in hardness than said tube body.

9. A nozzle device as claimed in claim 1, wherein said flange portion is made of three refractory layers of a lower layer, an intermediate layer, and an upper layer, said lower layer being made of the same material as said tube body which is less in hardness then said intermediate layer and said upper layer are made of materials which become greater in hardness in order than said tube body.

* * * * *